United States Patent [19]

De Vries

[11] 3,992,775

[45] Nov. 23, 1976

[54] ELECTRIC SHAVER WITH ADJUSTABLE SKIN-TIGHTENING MEANS

[75] Inventor: Jochem Jacobus De Vries, Drachten, Netherlands

[73] Assignee: U.S. Philips Corporation, New York, N.Y.

[22] Filed: Jan. 20, 1975

[21] Appl. No.: 542,351

[30] Foreign Application Priority Data

Feb. 14, 1974 Netherlands ..... 742011

[52] U.S. Cl. ..... 30/34.2; 30/43.1

[51] Int. Cl.[2] ..... B26B 19/42

[58] Field of Search ..... 30/43.1, 34.2, 43.4, 30/43.5, 43.6

[56] References Cited

UNITED STATES PATENTS

| | | | |
|---|---|---|---|
| 2,991,554 | 7/1961 | Somers | 30/34.2 |
| 3,148,447 | 9/1964 | Locke | 30/34.2 |
| 3,768,160 | 10/1973 | Bergsma | 30/34.2 |

*Primary Examiner*—Gary L. Smith
*Attorney, Agent, or Firm*—Frank R. Trifari

[57] ABSTRACT

An electric shaver with shear plates supported by a shear plate frame which is surrounded by a skin-tightening ring for adjusting the height of the shear plates. A flexible strip is movable in a direction transverse to said height adjustment, and cams on the strip drive the frame accordingly.

5 Claims, 2 Drawing Figures

ELECTRIC SHAVER WITH ADJUSTABLE SKIN-TIGHTENING MEANS

BACKGROUND OF THE INVENTION

The invention relates to an electric dry-shaving apparatus, which comprises:

a housing, an electric drive motor, one or more external shear plates, an internal cutting member cooperating with each shear plate and adapted to be driven by the electric motor;

a cutting plate frame supports the external shear plates and is connected to the housing.

A readily accessible adjusting member is movable transverse to a height adjusting means of a skin-tightening means and cooperates with the latter means, and a number of sloping surfaces around the shear plate frame with the skin-tightening means and the adjusting member cooperate with one another.

Such an electric dry-shaving apparatus is known from U.S. Pat. No. 3,768,160. In this known apparatus the shear plate frame consists of a substantially conical plastic member which is rigidly connected to the apparatus housing. The shear plates are mounted in three round openings of a substantially plate-shaped shear plate mount, which is slightly depressable and which is connected to the skin-tightening means by small bent wire springs. Thus, when removed, the skin-tightening means and the said shear plate mount which contains the shear plates and the cutters as well as a locking plate for the shear plates and the cutters form one coherent assembly. Said assembly is fitted onto the shear plate frame, and by means of spring-loaded levers which are disposed in the shaving apparatus and which extend through recesses in the side rim of the shear plate frame, it can cooperate with cams which are disposed at the inside of the skin-tightening means. Owing to the pressure exerted by the spring-loaded levers the skin-tightening means is pressed onto an annular adjusting member, which is disposed at the underside of the shear plate frame concentric with the skin-tightening means. The pressure which is exerted on the skin-tightening means by the spring-loaded levers, is imparted to the housing of the shaving apparatus via the annular adjusting member. On the housing, sloping surfaces are provided which serve for moving the skin-tightening means to and fro, which sloping surfaces co-operate with cam-shaped protrusions of the skin-tightening ring. Thus, turning the skin-tightening ring causes it to move to and fro, which movement is imparted to the resiliently loaded skin tightening means. The cams with which the skin tightening means co-operates with the spring-loaded levers also serve for adjustably supporting the skin-tightening means. In each position of the skin-tightening, the mount of the shear plates is pressed against the shear plate frame by the wire springs. Thus, when the skin-tightening means is moved to and fro the distance between the top edge of the skin-tightening means and the shear plates will vary. To remove the skin-tightening means and thus the mount with the shear plates, means are provided which ensure that the spring-loaded levers are rotated about their pivots in such a way that the assembly can be removed. Such a provision is necessary so as to allow the shear plates and the hair chamber therebeneath to be cleaned.

Said known construction requires a comparatively large number of components and takes up much space. The cost price of a dry-shaving apparatus may therefore be adversely affected, while moreover the styling of the apparatus should comply with certain requirements which are not always desirable.

SUMMARY OF THE INVENTION

It is an object of the invention to provide a dry-shaving apparatus of the type mentioned in the preamble, in which fewer components are required for the skin-tightening means, which means moreover is of substantially smaller dimensions. The invention is characterized in that the adjusting member consists of one or more movable, interconnected strips which are disposed between the shear plate frame and the skin-tightening means, and the skin-tightening means is connected to the shear plate frame such that the adjusting member cooperates both with the shear plate frame and the skin-tightening means by engaging parts.

One embodiment of the invention is characterized in that the strips are mutually connected to form a single flexible band which is made of an elastic material.

Preferably, an embodiment is employed which is characterized in that the band has a shape which in itself is closed. In this respect another embodiment may be used to advantage, which is characterized in that the band is made of a plastic by injection moulding and is substantially appreciably thinner than the distance of the skin-tightening means to the shear plate frame, but which at a number of locations has a thickness which substantially corresponds to said distance. Preferably, an embodiment is used which is characterized in that the wall of the shear plate frame which faces the strips has a number of inclined slotted recesses and that the strips have corresponding cams which engage with the slotted recesses.

An embodiment which performed well in practice is characterized in that the skin-tightening means at its side which faces the flexible band has a number of guide slots with upper and lower edges, and the flexible band has a multiplicity of bendable parts which cooperate with the upper and lower edges, the guide slots and the bendable parts constituting a snap-connection between the skin-tightening means and the flexible band.

The invention will be described in more detail with reference to the:

DETAILED DESCRIPTION OF THE PREFERRED EMBODIMENT

Figure 1:
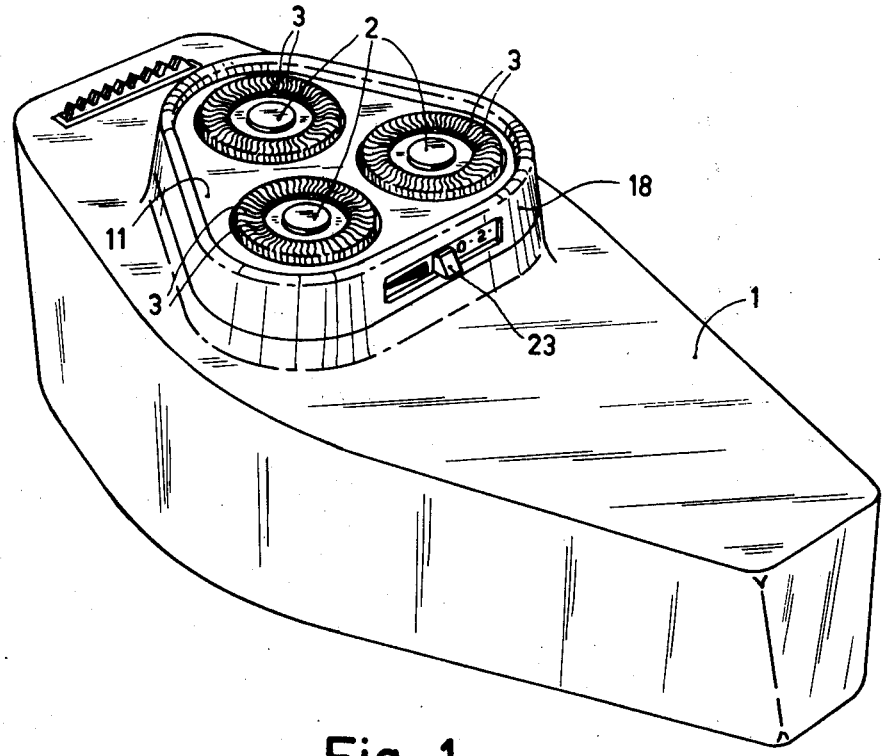
FIG. 1 is a perspective view of a dry-shaving apparatus according to the invention.
Figure 2:
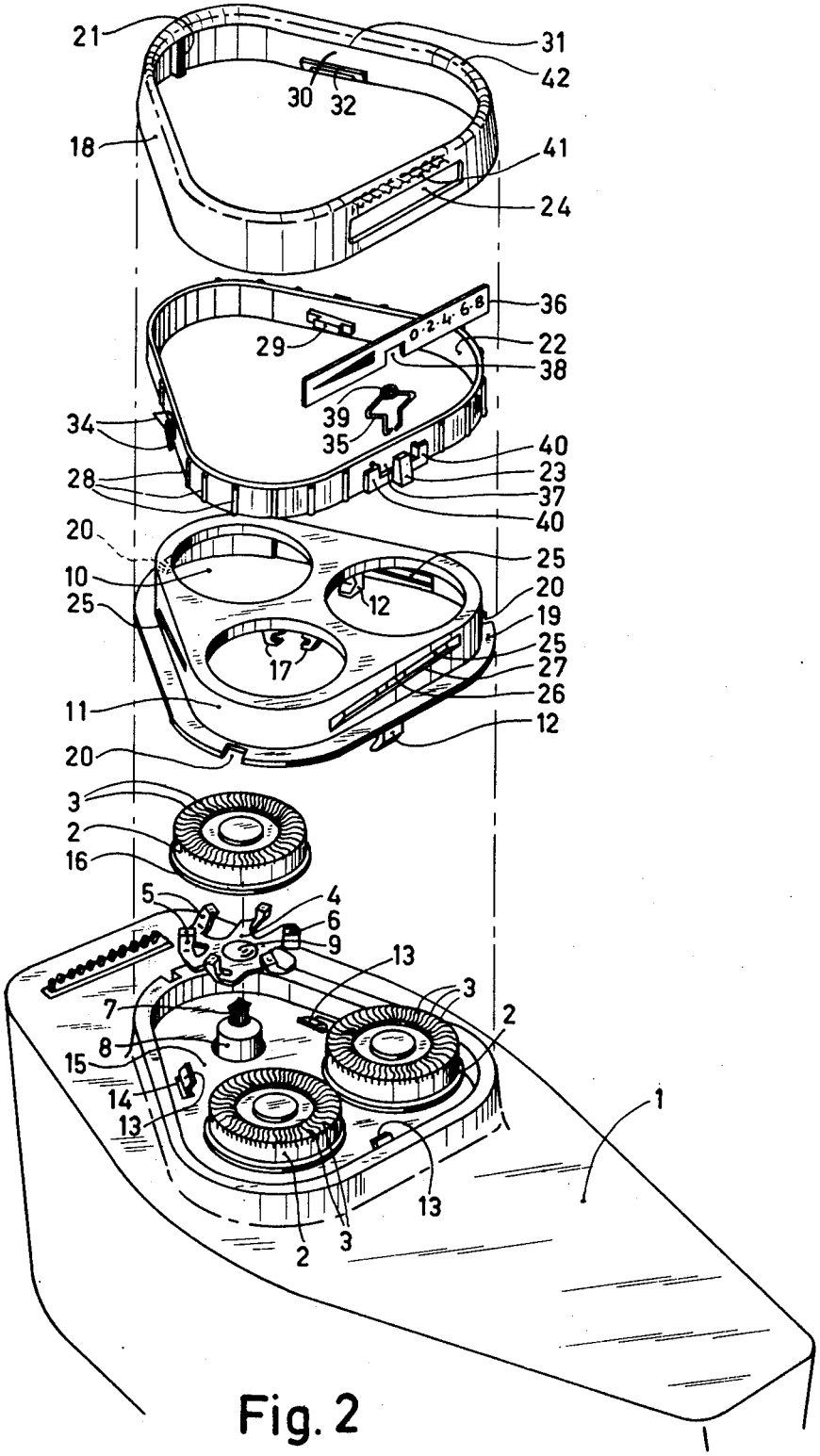
FIG. 2 is an exploded view of the tightening-rim mechanism of the dry-shaving apparatus of FIG. 1.

In both Figures corresponding parts are denoted by means of corresponding reference numerals. The shaving apparatus shown comprises a plastic housing 1, which accommodates an electric drive motor, not shown. There are three external round shear plates in the form of round cutter guards 2, each provided with a multitude of shaving slits 3, through which the hairs to be shaved off can pass. Each of the cutter guards 2 co-operates with an internal cutting member 4, one of which is shown in FIG. 2. The cutting members comprise six cutters 5, which are provided with cutting edges 6 which co-operate with the inside of the cutter guards 2. Each of the cutting members 4 can be driven by means of a coupling pin 7 which has a tight fit in a rotatable journal 8. In the underside of the internal cutting member 4, which side faces the coupling pin and is not visible in the drawing, a rectangular coupling slot is formed with which the coupling pin 7 cooperates. Over the coupling slot the protective cover 9 is disposed.

The cutter guards 2 are mounted in round openings 10 of a shear plate frame 11 which is connected to the housing 1. Said frame is a metal die-cast part, which has three hook-shaped cams 12 for connecting it to the housing 1 of the shaving apparatus as shown in FIG. 2. These cams cooperate with resilient brackets 13 which are disposed in recesses 14 in the bottom of the hair chamber 15. The diameters of the round openings 10 in the shear plate frame 11 are smaller than the flanges 16 with which the cutter guards 2 are provided. In the assembled condition the cutter guards 1 and the associated cutting members 4 are prevented from dropping out of the shear plate frame by means of a retaining plate, not shown. The retaining plate is not essential for the invention and is moreover known from the present state of the art i.e. U.S. Pat. No. 3,399,453. Such a retaining plate can be disposed below the cutter guards to limit downward movement, while the guards' flanges 16 limit upward movements; the plate is attached to the shear plate frame 11 with the aid of the cams 17 of FIG. 2.

The skin-tightening means 18 surrounds the shear plate frame 11 and is mounted adjustably in height relative to said frame. For bearing purposes the flange 19 of the shear plate frame 11 is provided with three recesses 20. The skin-tightening means 18 has only one rib 21 which cooperates with a corresponding recess 20 of the shear plate frame 11.

The skin-tightening means 18 can be moved up and down relative to the shear plate frame 11 which is attached to the housing 1, by means of the adjusting member 22 which is movable transverse to the direction of height adjustment of the skin-tightening means 18 and which cooperates therewith. The adjusting member 22 has a projecting part 23 which constitutes a control knob, which is movably disposed in a slot 24 in the skin-tightening means 18.

The shear plate frame 11 is provided with three sloping slots 25 at its circumference, whose lateral edges 26 and 27 serve as inclined surfaces with the aid of which the skin-tightening means 18 and the adjusting member 22 co-operate with each other for height adjustment of the skin-tightening means.

The adjusting member 22 consists of a movable strip which is disposed between the shear plate frame 11 and the skin-tightening means 18. Said strip is connected to the shear plate frame 11 in that it cooperates both with the shear plate frame 11 and with the skin-tightening means 18 by means of mutually engaging parts. The adjusting member 22 consists of a single flexible band made of an elastic material and of a shape which in itself is closed. It is an elastic ring which is injection-moulded from a suitable plastic, which only in the mounted condition has the substantially triangular shape of FIG. 2, but which in the non-mounted condition is rather circular.

The adjusting ring 22 is substantially appreciably thinner than the clearance between the inside of the skin-tightening means 18 and the outside of the shear plate frame 11, but at some locations it is provided with ribs 28 of such a thickness that the adjusting ring has a local thickness which substantially corresponds to the clearance between the said parts.

The walls of the shear plate frame 11 which face the adjusting ring 22 are provided with three sloping slotted recesses 25, which function as cam followers and cooperate with three corresponding cams 29 which are disposed at the inside of the adjusting ring 22 and which are integral therewith. Only one of said cams is visible in FIG. 2.

The skin-tightening means 18 comprises two guide slots 30 at its inside, which slots have upper and lower edges 31 and 32. The flexible adjusting ring 22 has a multiplicity of bendable parts 34 which co-operate with the guide slots 30. During assembly said bendable parts are slightly bent, so as to spring back into their original position in the assembled condition in which the parts are located in the space which is formed by the guide slot 30, so that said parts are retained between the walls 31 and 32. The bendable parts 34 and the recesses 30 thus together form a snap connection between the skin-tightening means 18 and the adjusting ring 22.

Mounting of the skin-tightening means 18 onto the shear plate frame 11 is effected as follows. The flexible adjusting ring 22 is placed around the raised part of the shear plate frame 11, the deformability of said ring allowing the cams 29 to readily engage with the recesses 25. After fitting a spring 35 and a plate 36, of which the function is to be explained hereinafter, the tightening rim 18 is fitted in the tilted position, the knob 23 being first inserted through the slot 24. Subsequently, the ring is pressed from its tilted position into its final position, the deformable parts 34 of the ring 22 bending first, to spring back into their original shape when they have assumed their final position in the guide slot 30, after which the ring 18 is connected to the adjusting ring 22 and via said ring also to the frame plate 11.

The spring 35 is accommodated in a chamber 37 which is located behind the knob 23, while the plate 36, which has a recess 38, is mounted on the adjusting ring 22 in that the recess 38 fits around knob 23 and the plate 36 engages with the surfaces 40 at either side of the knob 23. The spring 35 with its curled top end cooperates with a multiplicity of recesses 41 which are disposed underneath the curled-down top edge 42 of the skin-tightening means 18. Thus, a locking device is obtained for the adjusting ring 22, so that the adjusting ring 22 can be set to a number of discrete positions with the aid of knob 23. The setting can be identified by the numerical indication provided on the plate 36, which indication is visible through the window 24 in the skin-tightening means 18.

What is claimed is:

1. In an electric shaver including a housing, an electric motor mounted in said housing, a shear plate frame secured to said housing, at least one shear plate secured to said shear plate frame, and a cutter cooperating with each shear plate and coupled to said motor, the improvement in combination therewith of skin-tightening means comprising a rim adjacent said shear plate frame and having a top edge which surrounds said shear plate, said rim being movable for varying the height of said top edge relative to said shear plate, an adjusting member carried by said rim and movable on said rim transversely of said height direction, cam means formed on said shear plate frame as a slot means aligned angularly with respect to said height direction, and follower means on said adjusting member, said follower means comprising a projection movable in and engaging said slot, whereby said transverse movement of said adjusting member causes height movement of said member and of the rim carrying said member.

2. In an electric shaver including a housing, an electric motor mounted in said housing, a shear plate frame secured to said housing, at least one shear plate secured to said shear plate frame, and a cutter cooperating with each shear plate and coupled to said motor, the improvement in combination therewith of skin-tightening means comprising a rim adjacent said shear plate frame and having a top edge which surrounds said shear plate, said rim being movable for varying the height of said top edge relative to said shear plate, an adjusting member comprising a flexible closed-loop strip carried by said rim, conforming generally to said rim, disposed between said rim and shear plate frame, and movable on said rim transversely of said height direction, cam means on one of said shear plate frame and adjusting member components, and follower means on the other of said components, whereby said transverse movement of said adjusting member causes height movement of said rim via said cam and follower means.

3. Apparatus according to claim 2 comprising three of said shear plates in a plane and associated cutters carried by said frame, and said rim surrounds said three shear plates.

4. Apparatus according to claim 2 wherein said rim further comprises guide means for engaging said strip and guiding said strip in its transverse movement.

5. Apparatus according to claim 2 wherein said rim and frame are separated by a space of predetermined width, and said strip is disposed in said space and has thickness substantially less than said width.

* * * * *

UNITED STATES PATENT AND TRADEMARK OFFICE

CERTIFICATE OF CORRECTION

PATENT NO. : 3992775

DATED : November 23, 1976

INVENTOR(S) : JOCHEM JACOBUS DE VRIES

It is certified that error appears in the above–identified patent and that said Letters Patent are hereby corrected as shown below:

In the heading - Foreign Application Priority Data should read:

--Netherlands 7402011--

Signed and Sealed this

Twenty-second Day of February 1977

[SEAL]

*Attest:*

RUTH C. MASON
*Attesting Officer*

C. MARSHALL DANN
*Commissioner of Patents and Trademarks*